US008567640B1

(12) United States Patent
Johnson-Lofton

(10) Patent No.: US 8,567,640 B1
(45) Date of Patent: Oct. 29, 2013

(54) POP-UP MEDICINE BOTTLE CAROUSEL

(75) Inventor: Connie Johnson-Lofton, Snellville, GA (US)

(73) Assignee: LJC Therapy Services. Inc., Snelville, GA (US)

( * ) Notice: Subject to any disclaimer, the term of this patent is extended or adjusted under 35 U.S.C. 154(b) by 537 days.

(21) Appl. No.: 12/762,904

(22) Filed: Apr. 19, 2010

Related U.S. Application Data

(60) Provisional application No. 61/170,460, filed on Apr. 17, 2009.

(51) Int. Cl.
*B65H 1/08* (2006.01)
*G07F 11/00* (2006.01)

(52) U.S. Cl.
USPC ..... 221/232; 221/3; 221/192; 221/221; 221/255; 221/229; 221/254; 221/176; 221/276; 220/529; 220/263; 220/524; 220/909; 220/262; 220/264; 312/71; 312/35; 312/305; 211/59.2; 211/77; 248/131

(58) Field of Classification Search
USPC ..... 220/529, 263, 524, 909, 262, 264, 528, 220/495.06; 221/3, 192, 232, 221, 255, 221/229, 254, 176, 276; 312/71, 35, 305; 211/59.2, 77; 248/131
See application file for complete search history.

(56) References Cited

U.S. PATENT DOCUMENTS

| | | | | |
|---|---|---|---|---|
| 87,054 | A | 2/1869 | Larimore | |
| 280,304 | A | 6/1883 | Fuller | |
| 401,829 | A * | 4/1889 | Hall | 211/77 |
| 1,643,735 | A | 9/1927 | Baker | |
| 1,977,092 | A * | 10/1934 | Scurlock | 211/77 |
| 3,768,710 | A | 10/1973 | Eggers | |
| D232,341 | S | 8/1974 | Mudde et al. | |
| 4,779,759 | A * | 10/1988 | Seavey | 221/232 |
| 4,887,737 | A * | 12/1989 | Adenau | 221/3 |
| 4,887,759 | A * | 12/1989 | Alexander | 228/20.5 |
| 4,920,763 | A * | 5/1990 | Provest et al. | 62/378 |
| 5,062,531 | A * | 11/1991 | Coy | 206/564 |
| 5,082,132 | A * | 1/1992 | Tsai | 220/23.83 |
| 5,379,885 | A | 1/1995 | Chen | |
| 5,641,080 | A | 6/1997 | Humphrey et al. | |
| 5,730,316 | A * | 3/1998 | Falk | 221/122 |
| 6,439,406 | B1 | 8/2002 | Duhon | |
| 6,796,441 | B2 | 9/2004 | Tremblay | |
| 7,055,693 | B1 | 6/2006 | Goff | |
| 7,159,735 | B2 * | 1/2007 | Morse | 220/529 |
| 7,905,370 | B2 * | 3/2011 | Leonetti | 221/22 |
| 2002/0170868 | A1 | 11/2002 | Morgan | |

(Continued)

*Primary Examiner* — Gene O. Crawford
*Assistant Examiner* — Rakesh Kumar
(74) *Attorney, Agent, or Firm* — Parks IP Law LLC; Cynthia R. Parks, Esq.

(57) ABSTRACT

A portable carousel assembly for storing and facilitating access to medicine containers, such as plastic bottles commonly used for prescription or over-the-counter medications. Each medicine bottle is housed in a station that includes an aperture formed in a top plate of a rotatable receptacle. The rotatable receptacle is coupled to a stationary base. An ejection mechanism, such as a lever, cam track or ramp is operable to partially eject a selected medicine bottle from the receptacle so that it can be viewed or removed from the receptacle. The medicine bottle is maintained in the partially ejected condition by grasping means, such as flaps, gaskets, or webbing, or by operation of the cam track or ramp, so that the user need only use one hand to operate the carousel assembly and remove the medicine bottle.

15 Claims, 4 Drawing Sheets

(56) References Cited

U.S. PATENT DOCUMENTS

2005/0133545 A1* 6/2005 Find ..... 222/465.1
2007/0000805 A1 1/2007 Van Den Brink
2007/0084810 A1* 4/2007 Morris et al. ..... 211/65
2011/0272407 A1* 11/2011 Golcheh ..... 220/495.06

* cited by examiner

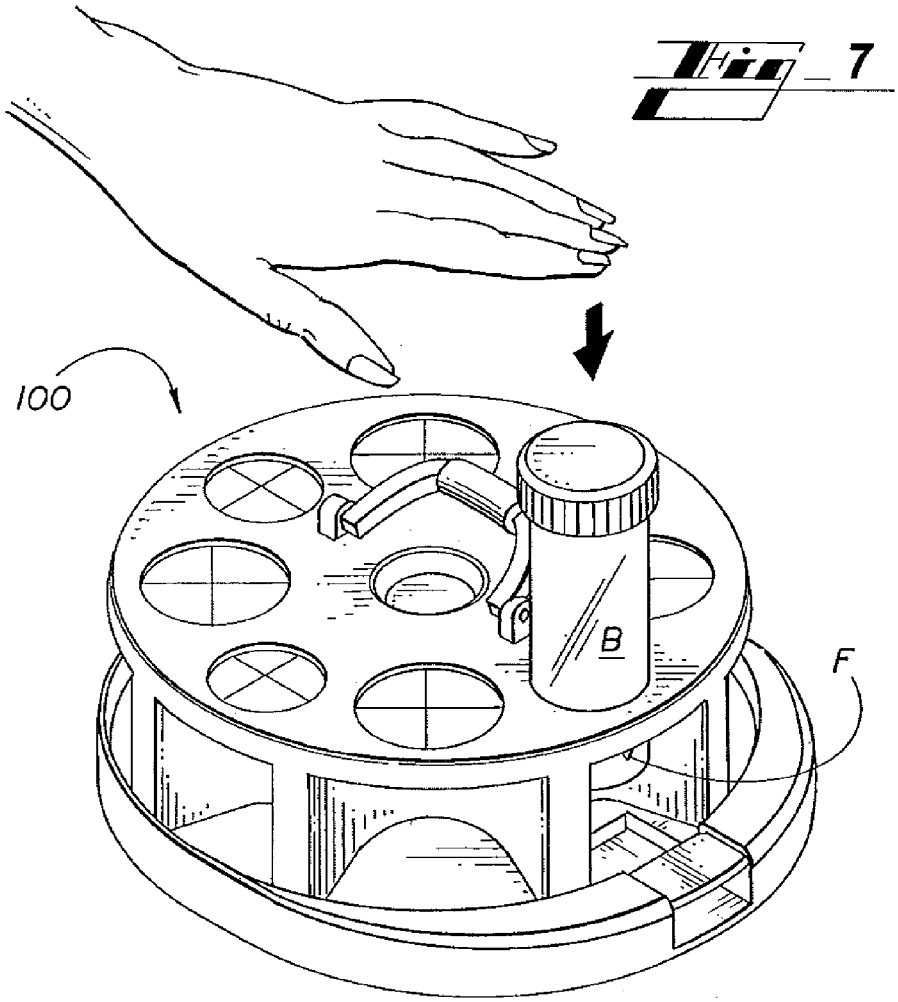
Fig. 7
Fig. 8
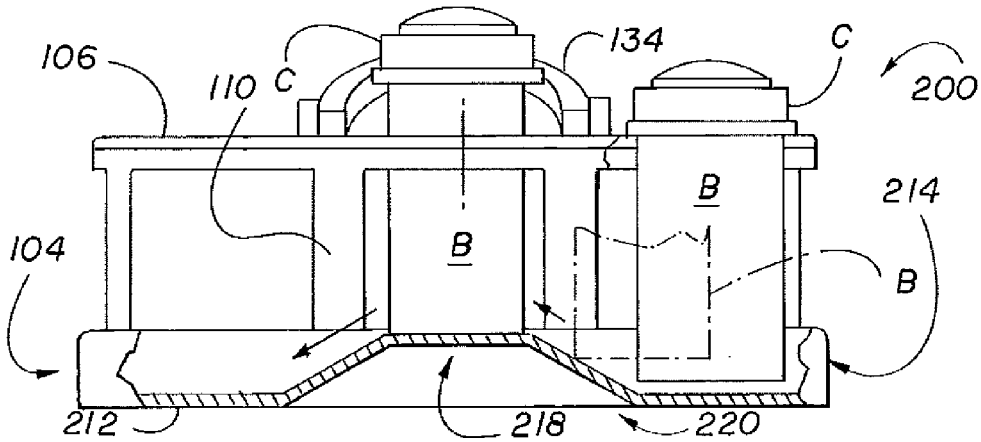

POP-UP MEDICINE BOTTLE CAROUSEL

RELATED APPLICATION

This application claims priority to U.S. Provisional Application No. 61/170,460, entitled "POP-UP MEDICINE BOTTLE CAROUSEL" filed on 17 Apr. 2009, the entirety of which is incorporated herein by reference.

TECHNICAL FIELD

This invention relates generally to medication dispensing devices, and more specifically, to a medicine bottle carousel having an elevating ejection feature.

BACKGROUND

Chronically ill, injured, or disabled outpatients are often prescribed many medications and supplements that are critical to their care, but compliance is typically left to the patients or caregivers. For many patients, a level of independence is important to their psychological well-being; however, the patients' physical or mental status may make adherence to a regimen difficult. For example, some patients suffer from reduced dexterity, vision loss, tremors, memory deficits and the like, which makes it difficult for the patient to organize, identify and keep track of numerous medicine bottles. The task is further complicated when the patient moves from room to room, such as from the bedroom at night to a living area during the day.

Transporting and managing several bottles of medicine individually increases the risk that medication will be left behind or dropped, which may result in inadvertent noncompliance or further injury to the patient. Typical solutions, such as transporting multiple medicine bottles in a box or bag, fall short because the bottles are disorganized, such that the labels are obscured and the contents cannot be easily visualized. Pill organizers with dose compartments also fail to suffice, because they each compartment is typically limited in size, lacks protective features (e.g., UV protection, hermetic seals, child proofing and the like) to ensure the potency and access is controlled, and must be loaded by someone having sufficient dexterity and mental clarity needed to avoid potentially devastating dosing and compliance errors.

What is needed is a system and apparatus that facilitates easy and orderly storage and access to multiple small containers such as medicine bottles.

SUMMARY

The invention is a carousel assembly for organizing, storing, and dispensing containers such as medicine bottles and the like. The carousel assembly includes a receptacle that functions to store multiple containers while placing each bottle in easy reach of a stationary patient, who simply rotates the receptacle until the desired container is in position for removal from the receptacle. The receptacle is supported by a base or pedestal, and is rotatable about an axis perpendicularly aligned with the plane of the base, in a "lazy-Susan" fashion. Advantageously, the carousel assembly includes an ejection mechanism that raises a container for ease of viewing and removal, and also holds the container in the raised position until the patient or other user wishes to lower it.

In an exemplary embodiment, the receptacle includes a substantially flat, circular top plate, and accommodates multiple medicine bottles in apertures formed in the top plate. The assembly is particularly useful for retaining medicine bottles having a topmost lip that is wider in diameter than the body of the bottle that extends through the aperture, such that the lip can be engaged by the plate. However, each aperture can snugly accommodate bottles and boxes of various sizes and shapes, including but not limited to cylindrical or rectangular containers commonly used for medicines, even where the bottle neck and cap (if any) are smaller in diameter than the body of the bottle. To that end, deformable grasping means such as flaps, webbing or gaskets may line or extend from all or part of each aperture. For example, in certain embodiments, four rubber or silicone flaps are secured along the periphery of several circular apertures such that the distal edges of the flaps define a crosshair at least partially obscuring the aperture.

A medicine bottle can be pressed into the aperture, thereby deflecting the flaps sufficiently to allow ingress while gripping the sides of the medicine bottle such that any cylindrical medicine bottle with a diameter less than the diameter of the aperture will be securely held within the aperture. Additionally, any suitably sized container with any cross-section, including but not limited to oval, polygonal, rectangular, triangular or trapezoidal containers can be held in the aperture.

In certain embodiments, each aperture defines a station, which may be used consistently to store a particular medication. To assist patients that have visual impairments, the top plate or other easily accessible portion of the receptacle may include tactile indicia, such as Braille type, raised lettering or symbols, or prominent labeling that identifies the medication that belongs in that station. In this fashion, the patient can identify the medication to be taken even more easily without necessarily reading the labels of the bottles one by one.

As mentioned above, the receptacle is rotatable. Rotation of the receptacle can be accomplished readily by simply advancing the receptacle about a rotational coupling. The base is preferably weighted or includes a means for securing the base to a surface such as a table top. In this fashion, the receptacle can be rotated, for example by the patient using one hand, without the entire apparatus sliding about on the table top. Examples of suitable means for securing the base include one or more suction cups, rubber gripping feet or other non-slip pads, weights, temporary or permanent adhesives, and similar non-slip material. This aspect is particularly useful to patients with limited mobility and dexterity.

Patients also benefit greatly from another aspect, namely, a pop-up dispensing feature that lifts the desired bottle above the plate for easy removal. To achieve this effect, the assembly includes a suitable ejection mechanism. The grasping means described above also serve to hold the bottle up after it is lifted, such that operation of the ejection means and removal of a bottle can be accomplished with one hand and need not be accomplished simultaneously.

In certain embodiments, the ejection mechanism includes an actuator that mechanically or electronically operates to exert upward forces on one or more of the bottles in the receptacle without fully ejecting the bottle, but so as to allow the patient to more easily grasp the upper portion of the bottle to remove it from the receptacle. Such embodiments have the advantage of allowing the patient to variably operate the ejection mechanism to achieve the desired degree of ejection. Suitable actuators include levers, push buttons, spring-loaded releases, plungers, and the like.

In other embodiments, the ejection mechanism includes a ramp or cam track that mechanically propels one or more of the bottles in the receptacle to partially eject them from the receptacle for removal by the patient. Such embodiments also advantageously ensure that the bottles remain in the partially ejected condition when desired. In other words, when the receptacle is rotated to bring the desired bottle is into the partially ejected condition, the ejection mechanism of these embodiments prevents the bottle from being pushed back into a retracted position inadvertently by, for example, a patient with very limited control of his or her hands and arms.

To facilitate carrying the carousel assembly, a handle may extend from either or both the bottle receptacle or the base. The handle may be pivotable with respect to the surface of the receptacle such that it may be folded down to lie flat next to the receptacle/medicine wheel.

In certain embodiments, the handle can be lowered to cover the medicine bottle tops.

In certain embodiments, the carousel assembly fits within a bowl-like enclosure that can attach to the carousel assembly or its base to enclose exposed portions of medicine bottles.

The foregoing has broadly outlined some of the aspects and features of the present invention, which should be construed to be merely illustrative of various potential applications of the invention. Other beneficial results can be obtained by applying the disclosed information in a different manner or by combining various aspects of the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION OF THE DRAWINGS

FIG. 7 is a perspective view of the carousel assembly, showing a container held in the partially ejected position by grasping means after activation of the ejection mechanism.

FIG. 8 is a partial cut-away perspective view of a second embodiment of the carousel assembly, showing a ramp style ejection mechanism.

DETAILED DESCRIPTION

Figure 1:
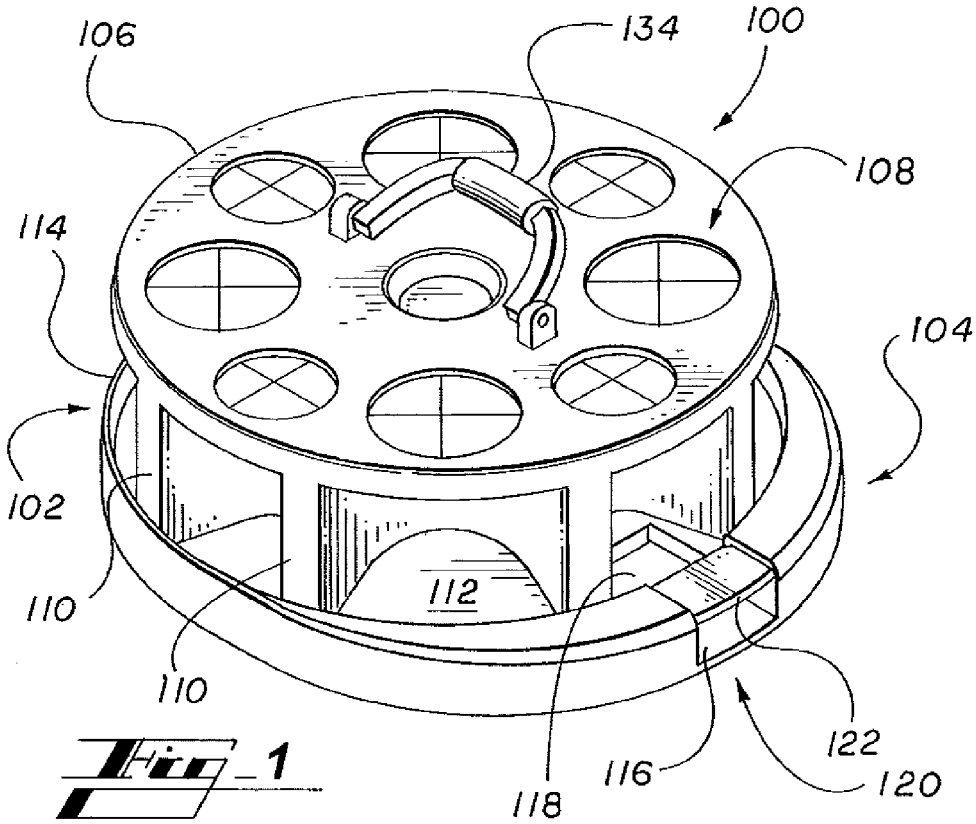
FIG. 1 is a perspective view of a carousel assembly for medicine bottles, according to an exemplary embodiment of the invention.
Figure 2:
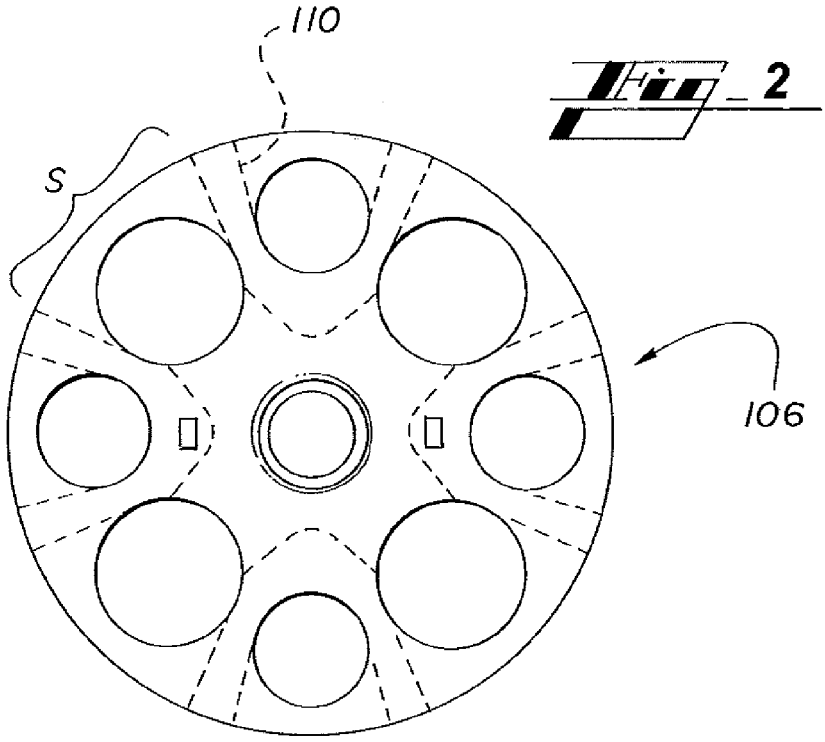
FIG. 2 is a plan view of a top plate forming the upper surface of a receptacle portion of the medicine bottle carousel.

As required, detailed embodiments of the present invention are disclosed herein. It will be understood that the disclosed embodiments are merely exemplary of the invention that may be embodied in various and alternative forms. The figures are not necessarily to scale, and some features may be exaggerated or minimized to show details of particular components. In other instances, well-known materials or methods have not been described in detail in order to avoid obscuring the present invention. Therefore, specific structural and functional details disclosed herein are not limiting but serve as a basis for the claims and for teaching one skilled in the art to variously employ the present invention.

Referring now to the drawings, FIGS. 1-7 illustrate a first embodiment, and FIG. 8 illustrates a second embodiment of a carousel assembly that exemplify the various aspects and teachings of the present invention.

FIG. 1 is a perspective view of a carousel assembly 100. The carousel assembly 100 includes a receptacle 102 and a base 104. The receptacle 102 includes a substantially circular top plate 106 having a plurality of apertures 108 disposed through it. The apertures 108 may vary in size and shape. Alternatively, the top plate 106 may have notches (not shown) in lieu of apertures. In either case, the top plate 106 will include means for receiving containers, such as medicine containers, shown as bottles B (best shown in FIG. 4).

The top plate 106 (best shown in FIG. 2) is separated from the base 104 by several supports 110, which in the exemplary embodiment, are shown as dividing walls. Alternatively, the supports 110 could include legs (not shown) or other suitable means for supporting the top plate 106.

The base 104 includes a floor 112 and a lip 114 that may extend vertically above the level of the floor 112. In the embodiment shown in FIG. 1, the floor 112 is substantially flat, permitting the supports 110 of the receptacle 102 to glide over the floor 112 as the receptacle 102 is rotated. In the exemplary embodiment, the carousel assembly 100 is made primarily of plastic, although any suitable material can be used for all or part of the device, including but not limited to glass, fiberglass, paperboard, wood, coated metal, fiberboard, and the like.

Figure 4:
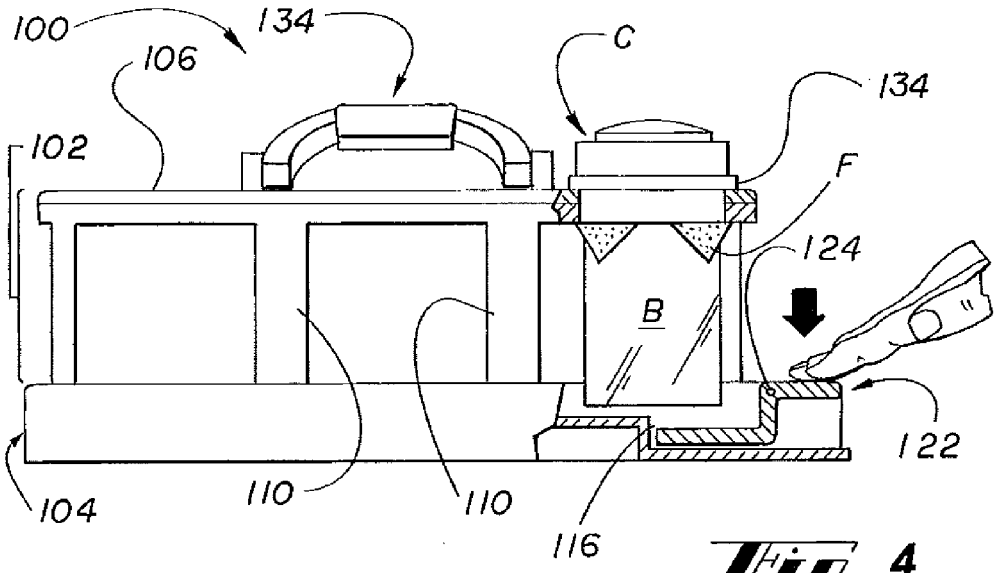
FIG. 4 is a partial cut-away side elevational view of the carousel assembly of FIG. 1, showing an exemplary ejection mechanism.
Figure 5:
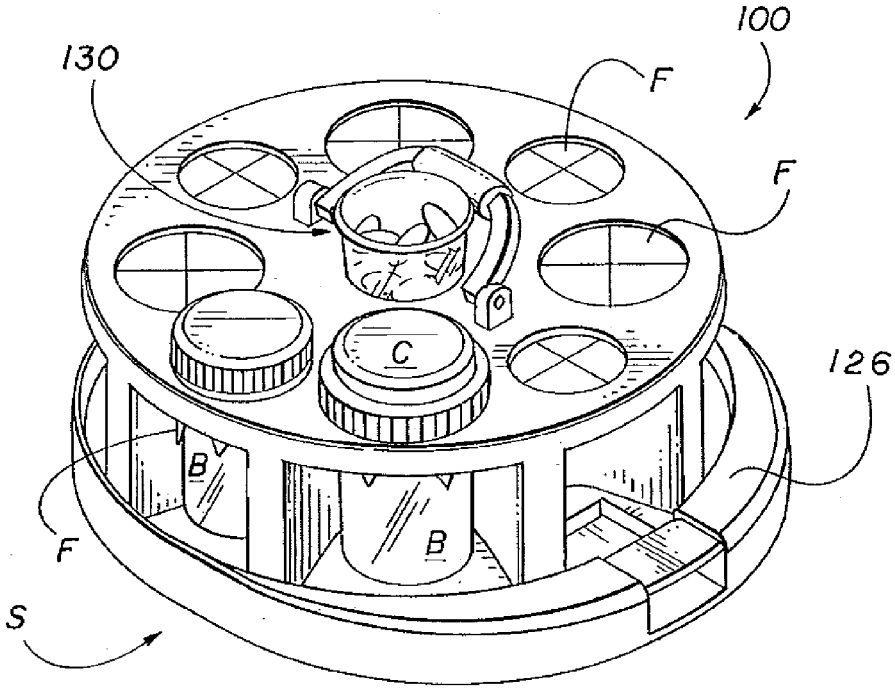
FIG. 5 is a perspective view of the carousel assembly, with several containers stowed in stations.
Figure 6:
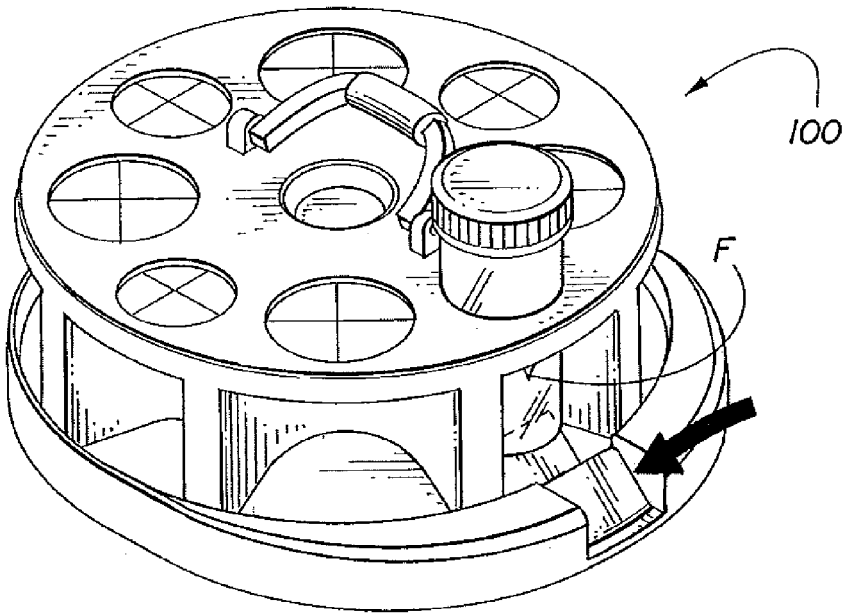
FIG. 6 is a perspective view of the carousel assembly, showing activation of the exemplary ejection mechanism to partially eject a container.

Referring now to FIGS. 1 and 4, the circumference of the inner rim of the lip 114 is at least as large as, and preferably slightly greater than, that of the exposed portion of the floor 112, so that the free movement of the supports 110 is not impeded by the lip 114. In the exemplary embodiment, the thickness of the lip 114 is increased on one side of the assembly space to define a projection 126, which includes a recess 116 that is aligned with a depression 118 that is disposed in the floor 112. Together, the recess 116 and the depression 118 house an ejection mechanism 120, which in the first exemplary embodiment includes a lever 122 and pivot point 124 (best shown in FIG. 4).

The receptacle 102 is rotatably coupled to the base 104 by any suitable means, such as but not limited to, a coupling assembly (not shown) that includes a sleeve, bearing joint, and rod. Detents (not shown) and complementary depressions (not shown) may be provided, e.g., on the supports 110 and the lip 114, to provide a tactile or audible indication that informs the user that the receptacle 12 has been rotated sufficiently to bring a station S into alignment with the ejection mechanism 120, and to facilitate optimal alignment.

Optionally, a well 128 is disposed in the center of the top plate 106 to receive small articles, such as but not limited to a dose cup 130. A handle 132 facilitates carrying of the entire carousel assembly 100, without separating the receptacle 102 from the base 104.

Figure 3:
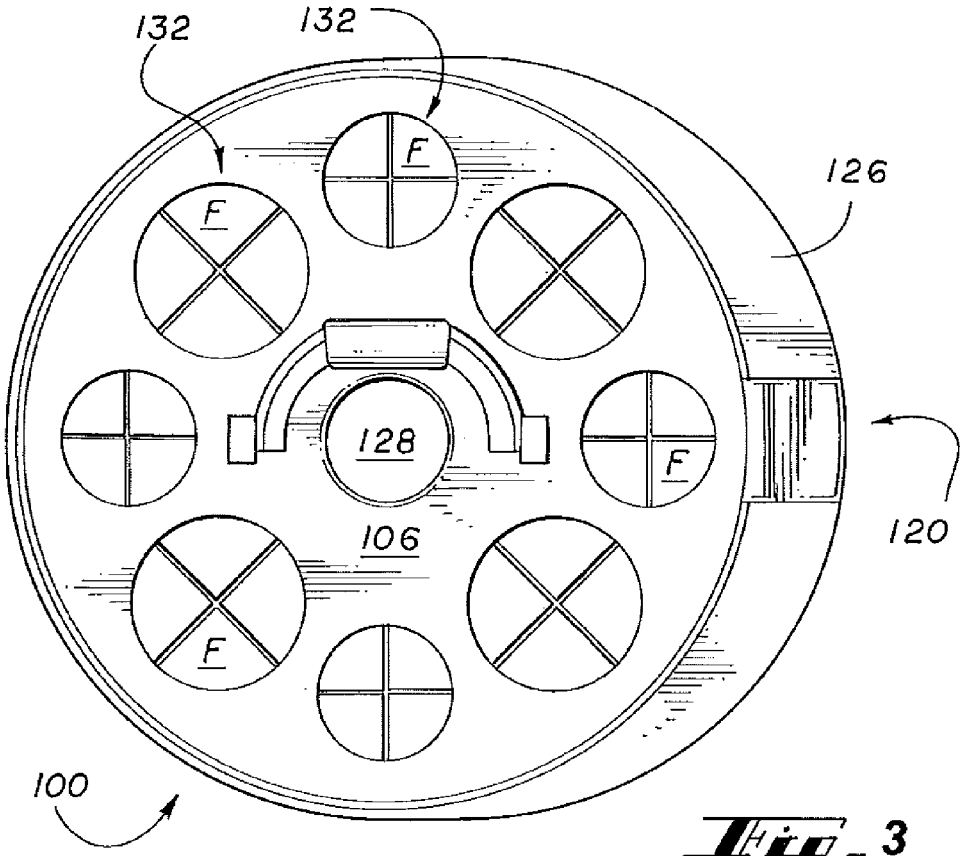
FIG. 3 is a plan view of the carousel assembly of FIG. 1.

Referring particularly to FIG. 3, grasping means 132 are operatively associated with each aperture 108, so as to increase the compatibility of each aperture with multiple sizes, shapes and types of containers. In certain embodiments, the grasping means 132 also function to hold a bottle B in the partially ejected condition while the user removes the bottle from the receptacle 102. In the illustrated embodiments, the grasping means 132 include multiple flexible flaps F that are secured to extend from the periphery of each aperture 108. It is contemplated that alternative grasping means (not shown) can serve the intended functions, such as but not limited to, a continuous flexible gasket extending along the periphery of the aperture, spring-loaded rollers, an elastic tubular sleeve, an aperture lining formed of a compressible material such as foam, and the like. The exemplary flaps F may be made of rubber or any other suitable flexible gripping material.

Referring now to FIGS. 4-7, the operation of the exemplary carousel assembly 100 will now be described, with particular emphasis on its ejection mechanism 120 and its grasping means 132. FIG. 4 shows the carousel assembly 100 just prior to operation by a user of the ejection mechanism 120, which includes as its actuator a mechanical lever 122, as revealed in the cut-away portion of the figure. The user has rotated a station S from an inoperative position (shown in FIG. 5) to an operative position (shown in FIG. 6). In the operative position, the station S is aligned with the ejection mechanism 120, so that it can be used to partially eject the bottle B that is stored in the station S for removal from the receptacle 102. It should be noted that partial ejection of the bottle B is also useful to enable the user to read the pharmacy label or other markings on the bottle B instead of or prior to removal.

By operation of the flaps F, or by engagement of a ring 134 on the bottle's cap C with the upper surface of the top plate 106, the bottle B may be suspended slightly above the floor 112 of the base 104 before the ejection mechanism 120 is operated. The lever 122 may be countersunk into the recess 116 as shown, but in any event, does not impede the turning of the receptacle 102 when the ejection mechanism 120 is not operated. Referring again to FIG. 6, when the user presses down on the lever 122, it pivots about the pivot point 124 and the lever 122 contacts the bottom of the bottle B to partially eject it. By varying the extent to which the user depresses the lever 122, the user can achieve variable ejection of the bottle B.

Referring to FIG. 7, the bottle B is advantageously held by the flaps F in the partially ejected condition after operation of the ejection mechanism 120, and in fact, stays in the partially ejected condition even after the lever 122 returns to its resting position (shown in FIG. 4). In some embodiments, the grasping means 132 is intended to eventually allow the bottle B to slowly sink back down in case the user forgets to press downward sufficiently after viewing the bottle B or replacing the bottle B after dispensing medication. In such embodiments, the grasping means 132 is designed to have a gripping ability that provides slightly less friction than is needed to hold the bottle B in the partially ejected condition indefinitely.

FIG. 8 illustrates a carousel assembly 200 according to a second embodiment of the invention. The carousel assembly 200 differs primarily in its use of an ejection mechanism 220 that includes an elevated section 218 of the floor 212 portion of the base 104. As the figure illustrates, the floor 212 is substantially flat except where it underlies an operative position. The bottom edges (not shown) of the supports 110 are shaped so as to avoid the elevated section 218. So, the receptacle 102 is rotatable (here, clockwise) to bring a bottle B from an inoperative position (the bottle at right), with the elevation of the bottle B increasing as the bottle B contacts the elevated section 218, to achieve a maximum elevation when the bottle B is in the operative position (the bottle at center). The ramp style ejection mechanism 220 eliminates the need for the user to actively operate the ejection mechanism 220. Rather, the user need only have sufficient dexterity to rotate the receptacle 102.

This embodiment is useful with or without grasping means, because the elevated section 218 holds the bottle B in partially ejected condition, which also reduces the friction that a potentially disabled person will have to overcome to pull the partially ejected bottle B from the receptacle 102. Alternatively, even though the elevated section 214 maintains partial ejection, grasping means still may be included to increase the compatibility of each operative with containers with various sizes and shapes.

It is contemplated that the embodiment of FIG. 8 can be modified to eliminate direct contact between the bottles and the elevated section 218 of the floor 212. For example, separately movable platforms may be provided beneath each of the bottles B, the platforms being deflected upward when they contact the elevated section 218 or are guided along cam tracks.

In addition to the ejection mechanisms described, it is contemplated that the principles of the invention could be realized by alternative mechanisms, such as but not limited to plunger mechanisms, and cam tracks with followers.

It must be emphasized this disclosure does not illustrate and describe every possible embodiment of the present claims. Hence, the above-described embodiments are merely exemplary illustrations of implementations set forth for a clear understanding of the principles and teachings of the invention. Many variations and modifications may be made to the above-described embodiments without departing from the scope of the claims. All such modifications, combinations, and variations are included herein by the scope of this disclosure and the following claims.

I claim:

1. A carousel assembly for medicine containers, comprising:

a base;

a receptacle rotatably coupled to the base, the receptacle comprising:

a top plate; and a plurality of stations defined at least in part by the top plate, each station for storing a medicine container in the receptacle; and an ejection mechanism comprising a lever that is operable to contact the bottom of a container when pressed by a user for partially ejecting at least one of the medicine containers to a raised position in relation to the top plate and in relation to the other medicine containers wherein each station is configured to retain and hold a medicine container in the partially ejected position without requiring further contact of the ejection mechanism.

2. The carousel assembly of claim 1, wherein each station comprises an aperture for receiving a medicine container.

3. The carousel assembly of claim 2, wherein the rotatable receptacle further comprises grasping means for securing each medicine container in a respective one of the stations.

4. The carousel assembly of claim 3, wherein the grasping means is formed from at least one material selected from the group consisting of: flaps, webbing, gaskets, and deformable lining.

5. The carousel assembly of claim 1, wherein the grasping means is formed from at least one material selected from the group consisting of: flaps, webbing, gaskets, and deformable lining.

6. The carousel assembly of claim 1, wherein the lever is associated with the base such that the lever is stationary without regard to the rotation of the receptacle.

7. The carousel assembly of claim 6, wherein the lever is operable to partially eject a medicine container when receptacle has been rotated so as to bring the station storing the medicine container into alignment with the lever.

8. The carousel assembly of claim 1, further comprising a well formed in the top plate, the well-being adapted to receive a small article.

9. The carousel assembly of claim 1, further comprising a handle for carrying the carousel assembly without separating the receptacle from the base.

10. The carousel assembly of claim 1, further comprising means for fixing the position of the base on a support surface.

11. The carousel assembly of claim 10, where the means for fixing the position of the base is selected from the group consisting of non-slip pads, suction cups, weights, magnets, and adhesives.

12. A carousel assembly for medicine containers, comprising:

a base;

a receptacle rotatably coupled to the base, the receptacle comprising:

a top plate; and a plurality of stations defined at least in part by the top plate, each station for storing a medicine container in the receptacle; and an ejection mechanism for partially ejecting at least one of the medicine containers to a raised position in relation to the top plate;

wherein:

the base defines a floor;

the ejection mechanism comprises an elevated section formed in the floor, where the elevated section extends above the otherwise substantially flat floor; and the elevated section is operable to partially eject a medicine container when receptacle has been rotated so as to bring the station storing the medicine container into alignment with the elevated section.

13. The carousel assembly of claim 12, wherein the rotating receptacle further comprises grasping means for securing each medicine container in a respective one of the stations.

14. The carousel assembly of claim 12, further comprising means for fixing the base on a support surface.

15. The carousel assembly of claim 14, where the means for fixing the base is selected from the group consisting of non-slip pads, suction cups, weights, magnets, and adhesives.

* * * * *